US007357159B2

(12) United States Patent
Popplau

(10) Patent No.: US 7,357,159 B2
(45) Date of Patent: Apr. 15, 2008

(54) CONTAINER TREATMENT DEVICE WITH A GAS CURTAIN

(76) Inventor: Jens H. Popplau, Irma-Sperling-Weg 35, Hamburg (DE) 22297

( * ) Notice: Subject to any disclaimer, the term of this patent is extended or adjusted under 35 U.S.C. 154(b) by 13 days.

(21) Appl. No.: 10/596,288

(22) PCT Filed: Dec. 10, 2004

(86) PCT No.: PCT/EP2004/014090

§ 371 (c)(1),
(2), (4) Date: Jun. 8, 2006

(87) PCT Pub. No.: WO2005/056465

PCT Pub. Date: Jun. 23, 2005

(65) Prior Publication Data

US 2007/0012377 A1 Jan. 18, 2007

(30) Foreign Application Priority Data

Dec. 11, 2003 (DE) ..... 103 58 265

(51) Int. Cl.
*B65B 1/04* (2006.01)

(52) U.S. Cl. ..... 141/92; 141/11; 141/69; 141/85; 53/426; 422/302; 422/304

(58) Field of Classification Search ..... 141/11, 141/69, 85, 89–92, 234; 53/403, 425, 426, 53/167; 422/28, 298, 302, 304
See application file for complete search history.

(56) References Cited

U.S. PATENT DOCUMENTS 5,060,449 A 10/1991 Klarl
5,178,841 A * 1/1993 Vokins et al. ..... 422/298
5,518,049 A * 5/1996 Herbreteau et al. ..... 141/85
6,691,747 B1 * 2/2004 Marcus et al. ..... 141/7
6,786,249 B2 * 9/2004 Armbruster et al. ..... 141/92

FOREIGN PATENT DOCUMENTS

| | | |
|---|---|---|
| DE | 10114660 | 10/2002 |
| DE | 10226710 | 1/2004 |
| EP | 1357081 | 10/2003 |
| WO | WO 03/106322 | 12/2003 |

* cited by examiner

*Primary Examiner*—Timothy L. Maust
(74) *Attorney, Agent, or Firm*—Rankin, Hill & Clark LLP

(57) ABSTRACT

Equipment for treating open beverage containers (3), e.g. by filling or closing, comprising: a treatment site (1), to which a container (3) can be delivered for treatment, and at which a treatment element (2) is situated that acts upon the mouth (6) of the container (3) from above, and slit nozzles (4), which are situated to the side of the treatment site (1), and discharge clean gas, and which are designed for producing a gas curtain that protects the area of the mouth (6) of the container (3). The invention is characterized in that the slit nozzles (4) are placed in, in essence, oppositely oriented jet directions whereby between the slit nozzles (4), a pressure flow is produced having flow components exiting upward and downward from the area of the slit nozzles (4) perpendicular to the plane of symmetry (S).

8 Claims, 5 Drawing Sheets

CONTAINER TREATMENT DEVICE WITH A GAS CURTAIN

BACKGROUND OF THE INVENTION

Open beverage containers such as cans or bottles must be treated under conditions that are as clean as possible, in order to preclude contaminating the containers with germs that would degrade the beverage's shelf life and taste. Regarding oxygen-sensitive beverages such as beer, exposure to oxygen also must be precluded during treatment, for instance during filling. It is known to treat the container in a clean room that contains the entire equipment even though this measure entails costly enclosure construction.

The German patent document DE 101 14 660 C2 discloses equipment of this kind where merely the region of the treatment site is protected by a curtain of clean gas against exposure to germs and oxygen. As regards this known design, a slot nozzle is configured at the treatment implement to annularly enclose the implement and projects a tubular gas curtain downward and in the direction of the container axis.

This design eliminates an expensive clean gas room around the equipment. However, this design also incurs the drawback that the flow direction of the gas curtain is directed from the treatment implement to the container, namely toward the container mouth. Contaminants piercing the gas curtain may thereby be forced toward the mouth and cause contamination. When a container is filled in the open, another problem arises, namely that the air expelled from the container, that most of the time is charged with germs and oxygen, will collide in opposite direction to the flowing gas curtain and be strongly perturbed by it. Accordingly, the interfering air from the container is not evacuated cleanly, but instead may be made to return on account of turbulence into the filling substance, that is back into the container and contaminate it again.

The objective of the present invention is to create equipment of the above kind and of simple design that shall be reliably secure from contamination.

BRIEF SUMMARY OF THE INVENTION

In the present invention, slot nozzles are configured laterally with respect to the treatment site and project clean gas toward each other. Accordingly a rammed flow is generated between the slot nozzles, whereby the mutually incident gas jets are deflected on both sides into the direction of the treatment site axis, that is, upward and downward. Of the two slot nozzles projecting gas at each other, one flow component runs upwards above a plane of symmetry passing through the two slot centers and another flow component runs downward. When the container is configured by its mouth in one of the flow components, it is situated in the entirely clean flow applied from the slot nozzles and therefore is wholly safe against contamination during treatment. A clean gas curtain is created, bilaterally enclosing the treatment site, and also encloses the treatment implement. A clean room enclosing the equipment can be eliminated entirely. Using only gas flow, a "clean room" flow-dynamically enclosing the treatment site is generated. All container treatment procedures can be carried out while being soundly protected within the protective gas curtain. When the treatment implement is the filling implement, it may be pressed against the container mouth for sealed filling. In that case, contaminant access is precluded before the filling implement has been set against the mouth and after it too. In particular, filling may also be carried out in an open way, that is with a gap subtended between the filling implement and container during the filling procedure. If the filling implement is designed as the sealing element, contaminant access will be precluded before such sealing.

The container mouth may be configured in the flow component issuing downward from the slot nozzles. If the plane of symmetry is configured below the container mouth, a clean gas curtain is implemented that runs past the mouth above the plane and that protects the entire treatment site against contamination. The other portion of the rammed flow runs downward past the container and precludes the upward portion of the rammed flow from aspiring contaminated gas from below from the region between the nozzles and the container. The clean gas flow directed past the container mouth to the treatment implement therefore is protected in an extraordinarily effective manner against contaminant penetration and is directed in the vicinity of the container mouth away from this mouth in a manner that no gas is forced into the container or toward the mouth, a gas transport instead being generated by means of the upward-pointing gas curtain and entraining contaminants present at the container and in particular also entraining air issuing from the container during the filling procedure. Because the exiting air and the gas curtain point in the same direction, interfering turbulences that might move contaminants in undesired directions are precluded.

According to an embodiment of the invention, the slot nozzles are configured in the free atmosphere, whereby, as already mentioned above, equipment design becomes very simple and makes a clean room housing superfluous.

The slot nozzles may be configured at a single treatment site in the form of annular nozzles. However, a row of treatment sites is advantageously employed with one slot nozzle on each side of the row and parallel to it. This design is applicable both to linear and rotary machinery.

When, for instance, using a rotary machine, the radially outward slot nozzle may be fixed in place and the radially inner slot nozzle may be co-rotating with the revolving carrousel machine.

The containers are fed within a housing-enclosed clean gas room to the treatment site and then are evacuated from it. The treatment site is situated outside the clean gas room and can be accessed from the room through an aperture of the clean gas room housing, the containers being fed through the aperture to the treatment chamber and being withdrawn again into the room. The slot nozzles are configured at the aperture edge. In this embodiment, there may again be an annular nozzle at a single treatment site or, for instance, one slot nozzle at each edge of an elongated aperture of a rotary machine, optionally one of said slot nozzles again being fixed in place and the other being co-rotating. There results a treatment site wherein the containers are continuously kept in the clean gas atmosphere, namely either in the clean gas room or in the treatment site which is protected by the clean gas curtain of the slot nozzles. This design offers the very substantial advantage that the treatment implements may be configured outside the clean gas room, a substantial design simplification being attained, and also allowing open access to the treatment site, for instance in the event of malfunctions.

By configuring the slot nozzles obliquely upward or downward, the proportions of the upward and downward rammed flow components may be changed relative to each other. Depending on the geometry of the treatment site, illustratively the flow around the container or the treatment implement may be improved. If the slot nozzles are configured in the aperture of a clean gas room, the component flowing from the slot nozzles into the clean gas room may be used to rinse this room and, by obliquely configuring the slot nozzles, the rinsing component may be adjusted relative to the upwardly issuing component rinsing around the treatment site. Be it borne in mind, in that respect, that the rammed flow generated at a clean gas room aperture encounters less impedance outward into the ambience than toward the inside of the clean gas room.

Screening walls adjoining the slot nozzles and enclosing the treatment site laterally screen this location and preclude atmospheric air flows reaching the treatment site from generating turbulences in the region of the treatment site. Accordingly, the screening walls assure that the slot nozzle components rinsing around the treatment site shall remain unperturbed. The screening walls also may be used when shaped in a particular manner to guide the slot nozzle flow components. Moreover, these screening walls may be used to decelerate the flow component in order to adjust, as desired, the upwardly flowing component relative to the proportion of the downwardly flowing component.

BRIEF DESCRIPTION OF THE DRAWINGS

The present invention is shown in schematic and illustrative manner in the appended drawings.

DETAILED DESCRIPTION OF THE INVENTION

Figure 1:
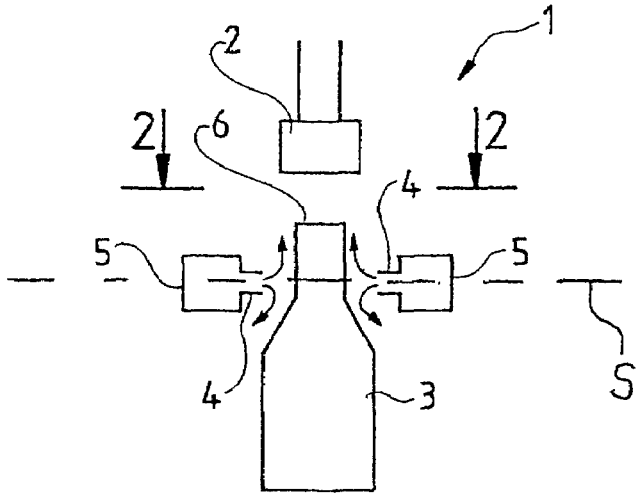
FIG. 1 is a sideview of a simple treatment site.

In much schematized manner, FIG. 1 shows a treatment site 1 fitted with a treatment implement 2 and with a bottle 3 configured in the treatment position underneath the implement. Slot nozzles 4 are mounted at the height of the bottle 3, for instance as shown at the height of its neck, that is, the upper end zone of the bottle 3. The slot directions run perpendicularly to the plane of the drawing, each being fed by a gas pipe 5 which is connected (in a manner not shown) to a compressed clean gas supply. This clean gas foremost must be germ-free. Conventionally, sterilized air is used for such purposes. When oxygen-susceptible beverages such as beer are to be filled into the bottles, then a clean gas free of oxygen, for instance CO2 or N2, must be used.

As shown by FIG. 1, the slot nozzles point at each other in such a way that they issue the gas in a flow direction indicated by the arrows one against the other, the rammed flow generating up and down flow components in the presence of a bottle and also in the absence of a bottle during container change. FIG. 1 shows the dashed line S passing through the centers of the two slot nozzles 4. This is the plane of symmetry S of the rammed flow. Gas above this plane of symmetry flows upward, gas below downward.

The upward flow component creates a clean gas curtain flowing past the bottle mouth 6 and past the treatment implement 2 and enclosing bilaterally the treatment site 1, precluding access of air from the contaminated ambient atmosphere. Accordingly, the zone of the mouth 6 of the bottle 3 and the lower end zone of the treatment implement 2 are kept free of germs, and where called for, free of oxygen. In order to attain this direction of flow of the gas curtain in the zone of the mouth 6, the plane of symmetry S may be situated, as shown in FIG. 1, below the mouth 6. Illustratively the plane of symmetry is situated at the height of a bottle's neck or, if the container for instance is a beverage can, at the upper end zone of this can, in relation to, in all cases, the height at which the container is being processed.

In the embodiment mode of FIG. 1, the slot nozzles 4 comprise a comparatively narrow slot. However the slot may be substantially wider, for instance corresponding approximately to the container height. In that case too the rammed flow components already discussed above, which above the plane of symmetry S point upward and below point downward, are created.

The air curtain generated by the rammed flow of the slot nozzles 4 points upward and entails suction at the bottle's mouth 6 whereby any contaminants present or generated there are entrained away without turbulence.

The bottle 3 is shown in the treatment position in FIG. 1. It is moved into the shown position by being lifted from below or it is moved perpendicularly to the plane of the drawing into the operational position underneath the treatment implement 2. For the sake of simplicity, the required moving and lifting elements are omitted from the Figure. They may be conventional. Moreover, the treatment site together with the slot nozzles 4 and the treatment implement 2 may be displaced in height relative to the bottle 2 of which the height is fixed.

The treatment implement 2 may be a filling element deposited in sealing manner on the mouth 6 by means of the relative displacement between the treatment implement 2 and the bottle 3. However, the filling element also may be designed for filling in the open configuration at the shown height differential. Furthermore, the treatment implement 2 may also be used for other purposes, for instance for sealing, for instance being a screwhead or a crown cork sealing head.

As shown in FIG. 1, the rammed flow produced by the slot nozzles 4 also generates a downward component. This downward component assures no extraneous air may enter the space between the slot nozzles 4 or be aspirated by the upward component. Accordingly the downward component also seals the lower part of the treatment site enclosed by the upward gas curtain and therefore allows dispensing with mechanical seals.

Instead of moving the bottle 3 from below into the treatment position as already mentioned with respect to slot nozzles 4 fixed in height, the slot nozzles also may be moved from a raised container exchange position into the shown treatment position when the bottle is fixed in height.

Moreover other containers, for instance beverage cans, can also be treated instead of the bottles 3 shown.

Figure 2:
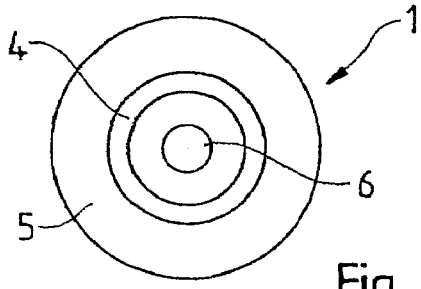
FIG. 2 is a sectional topview along line 2-2 of FIG. 1 of a single treatment site fitted with an annular nozzle.

FIG. 2 is a top view in section along 2-2 of FIG. 1 of an embodiment variation of a single treatment site 1 with a single treatment implement 2 (not shown in FIG. 2). In this instance the slot nozzles 4 are annular as shown in FIG. 2.

A tubular curtain exhibiting rotational symmetry relative to the axis of the treatment site 1 is generated by the rammed flow and protectively encloses the treatment site.

Figure 3:
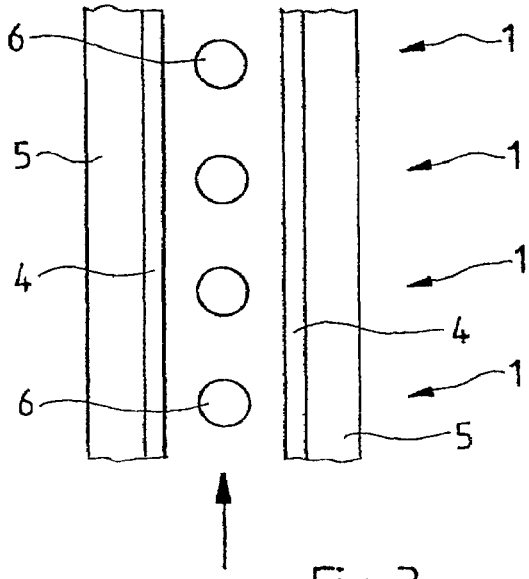
FIG. 3 is an elevation relating to FIG. 2 in topview of a configuration of several treatment sites in a row with two parallel slot nozzles.

FIG. 3 shows a preferred embodiment variation of the design of FIG. 1 as a section along line 2-2. This design comprises a row of several treatment sites 1, each comprising one bottle. The slot nozzles 4 run parallel on each side to the row of treatment sites and are straight in this illustrative embodiment. Illustratively, this may be a parallel filling machine wherein several bottles are synchronously fed to a row of treatment sites. As already discussed in relation to FIG. 2, the bottles also can be moved in the gap subtended between the two slot nozzles 4 in the direction of the arrow, the omitted treatment implements illustratively being carried along the moved bottles. The shown bottles or other containers to be treated may be raised from below between the parallel slot nozzles 4, as explained to FIG. 2, or may be transported at constant height and be introduced from one end of the linear apparatus between the slot nozzles, for instance in the direction shown by the arrow.

The slot nozzles 4 shown in FIG. 3 may both be configured fixed in place. However one of the two slot nozzles may be fixed and the other may be displaceable in the direction of the arrow.

Figure 4:
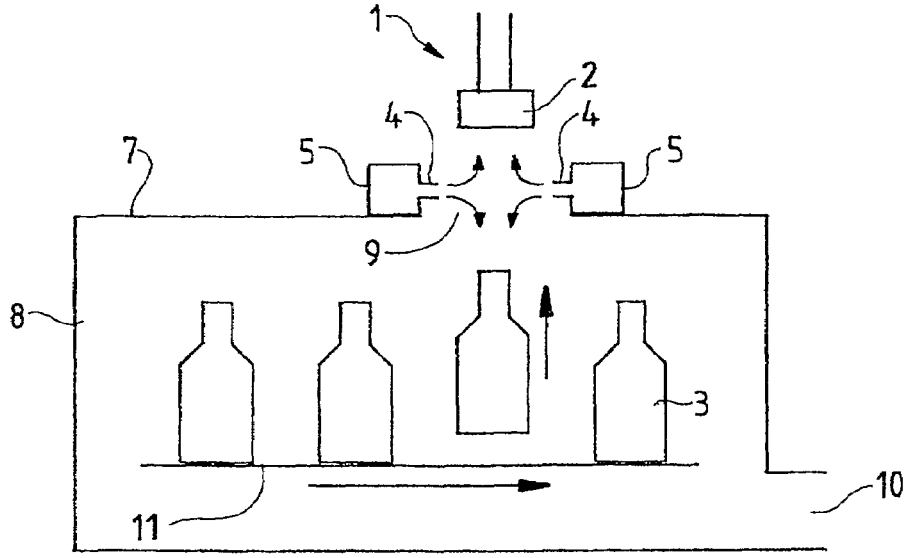
FIG. 4 shows slot nozzles at the aperture of a clean gas room.

FIG. 4 shows a clean gas room 8 enclosed by a housing 7 and comprising an upper aperture 9 and an air exhaust vent 10. The bottles 3 are moved by a conveyor 11 in the direction of the arrow within the clean gas room 8. When a bottle 3 is in position underneath the aperture 9, it can be raised in the direction indicated by the arrow until engaged in the aperture 9.

The slot nozzles 4 shown in FIG. 1 are configured at the edge of the aperture 9 and generate the rammed flow already discussed in relation to FIG. 1. The treatment implement 2 is positioned above the aperture 9. Accordingly the treatment site 1 is configured outside the aperture 9 of the clean gas room 8. If the already raised bottle 3 of FIG. 4 is raised further until it is in the position shown in FIG. 1, then it also may be treated in the very same way as described in relation to FIG. 1.

Again the rammed flow shown in FIG. 4 generates a gas curtain which protects the upward treatment site 1. The rammed flow's downward component moves clean gas into the clean gas room 8 which it flushes thoroughly to maintain constant purity. The clean gas can escape through the exhaust vent 10. Furthermore omitted sluice gates also may be used as exhaust vents through which the bottles 3 are guided into and out of said clean gas room 8.

As regards the embodiment of FIG. 4, the upward rammed flow component moves into the ambience whereas the downward component pointing into the clean gas room encounters an impedance that is substantially determined by the size of the exhaust vent 10. As a result, an excess of air from the rammed flow might move upward and not enough downward into the clean gas room 8.

Figure 5:
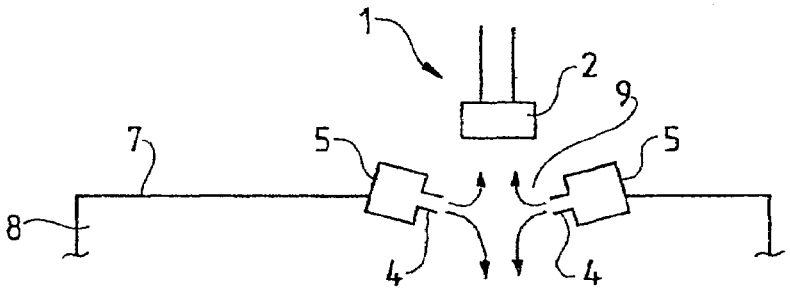
FIGS. 5 and 6 show embodiment variations relating to FIG. 4.

FIG. 5 shows an embodiment variation relative to FIG. 4 in that the slot nozzles 4 point obliquely downward at the edge of the aperture 9 of the clean gas room 8. As a result and as shown in FIG. 5, the rammed flow is asymmetrical and its downward component is larger. In this manner the impedance opposing the downward component can be overcome. Adjusting the obliqueness angle of the slot nozzles 4 allows adjusting, as desired, the upward rammed flow component relative to the downward component. The oblique attitude of the slot nozzles 4 shown in FIG. 5 furthermore may also be used in the embodiment mode of FIG. 1, that is the clean gas room being absent, to adjust the flow components issuing form the slot nozzles 4 upward and downward in a desired manner to each other. Illustratively more gas may be made to flow upward around the treatment implement 2.

Figure 6:
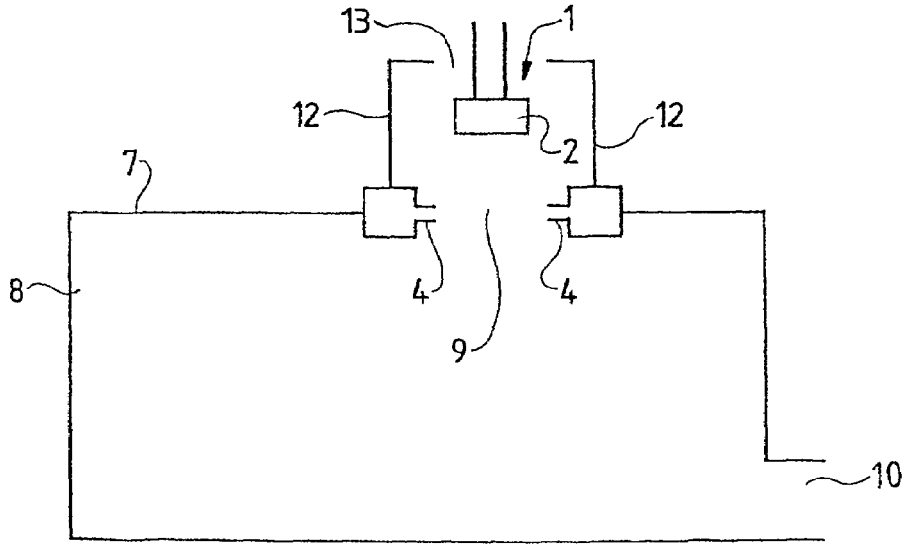

FIG. 6 shows a further related variation whereby screening walls 12 enclose the treatment site 1 outside the aperture 9, the walls communicating with the atmosphere through an opening 13. In this case, the slot nozzles 4 may be configured exactly opposite of each other as they are in FIG. 1 or 4. In this embodiment, the ratio of the upward flowing component of the rammed flow to the downward component flowing into the clean gas room 8 is determined by the cross-sectional ratio of the opening 13 to the exhaust vent 10 and can be set by appropriately selecting the pertinent dimensions. Additionally, as regards the embodiment of FIG. 6, the gas conveyance ratio may be affected by the obliqueness of the slot nozzles 4.

The screening walls 12 implement a substantial function in that, in the region of the treatment site, they shall offer shielding against air flows impinging from the sides. If strong air flows prevail in the general area where the equipment of FIG. 6 is located, they may interfere at the treatment site 1 with the upward gas component issuing from the slot nozzles 4 and thereby move contaminated air into the region of the treatment site 1. This eventuality is precluded by the lateral screening by the screening walls 12. Such lateral screening makes it possible to operate at very weak flows (low gas speeds) issuing from the slot nozzles. The screening walls 12 shown in FIG. 6 also may be used and be equally effective with the other above shown embodiment modes, for instance those of FIG. 2 and also of FIG. 3.

As regards the designs of FIGS. 4, 5 and 6, the aperture always may be a round hole underneath a single treatment implement 2. In that case, the slot nozzles 4 are designed to be an annular nozzle running along the hole rim in the manner shown in FIG. 2. One clean gas room may be fitted with several such apertures.

However the aperture 9 of the designs 4 through 6 also may be in the form of an elongated gap subtended by parallel slot nozzles 4 as shown in FIG. 3. The aperture gap need not mandatorily be straight. The gap also may be arbitrarily curved and bent. As shown in FIG. 4, the containers may be lifted out of the clean gas room into the aperture gap. However this aperture gap 9 also may run as far as the edge of the housing 7, whereby the containers may be moved from there at constant height as far as into the treatment site.

Figure 7:
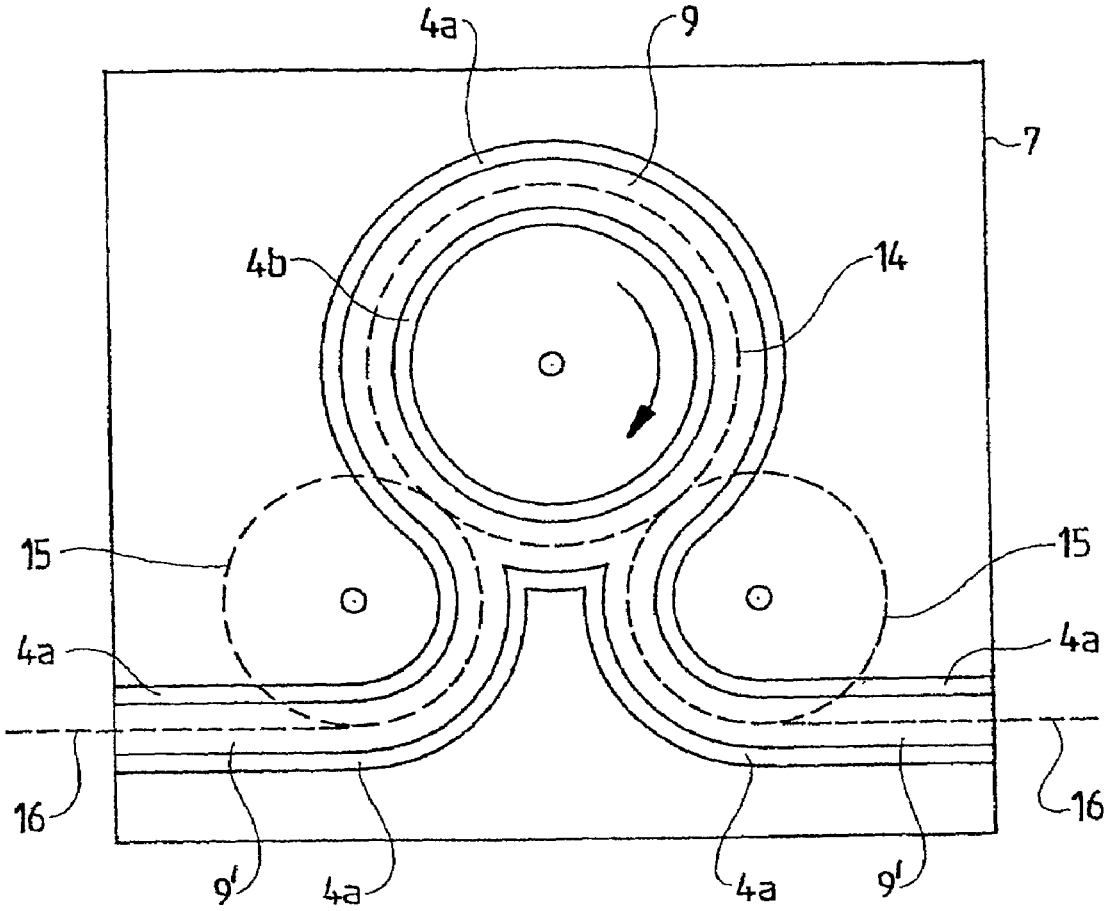
FIG. 7 is a top view of a clean gas room for a rotary beverage filling machine comprising an annular aperture fitted with slot nozzles, FIG. 8 schematically shows the region of the slot nozzles in the manner of FIG. 1 but of a somewhat altered geometry.

FIG. 7 is a top view of the upper wall of a housing 7 enclosing a clean gas room. This room contains a carrousel bottling machine 14, for instance a filling machine which is fed with containers by means of feed and evacuation star wheels 15 and conveyors 16. The feed and evacuation conveyors 16 run through sluice gates of the housing 7.

The aperture 9 is configured as an annular gap above the carrousel 14 and comprises slot nozzles **4*a* and 4*b* at its edges. Treatment implements are mounted above the carrousel 14, namely above the housing 7 and rotate with this carrousel, the implements being omitted from FIG. 7 for graphic clarity. The radially external slot nozzle 4*a* at the aperture 9 is affixed in place in the top wall of the housing 7. The radially inner slot nozzle 4*b* rotates jointly with the carrousel 14, for instance in the direction of the shown arrow. The rotating slot nozzle 4*b* may rotate together with part of the surface of the housing 7 it encloses, namely with the rotating part of the carrousel machine 14 and with the treatment implements mounted above, that is outside, the housing 7**.

The containers move by means of a conveyor 16 and a star wheel 15 onto the carrousel 14 and rotating with latter arrive at the aperture 9. The containers to be treated may be moved on the conveyors 16 and in the star wheels 15 in a lowered position, that is, underneath the upper wall of the housing 7 and then must be raised in the region of the gap aperture 9. Preferably, however, the design shall be as shown in FIG. 7. Above the full length of container transport, that is above the conveyors 16 and above the segments of the star wheels 15 revolving with containers, there are gap apertures 9' emanating from the gap aperture 9 which are fitted on both sides with fixed slot nozzles 4*a* and which run as far as the edge of the housing 7. Within this continuous gap guide, the containers can be moved at the same height through the entire machine. All design variations shown in FIGS. 4 through 6 also are applicable to this particular design.

The gap configuration shown in FIG. 7 also may be free-standing, that is without the housing 7, that is without a clean room underneath the slot nozzles. The slot nozzles may be free-standing, as shown in FIGS. 1 and 3, though they are fitted with a carrousel 14 and star wheels 15 of the constrained path in FIG. 7. Such a design allows making in an especially simple manner a revolving, sterile bottling/filling machine.

Figure 8:
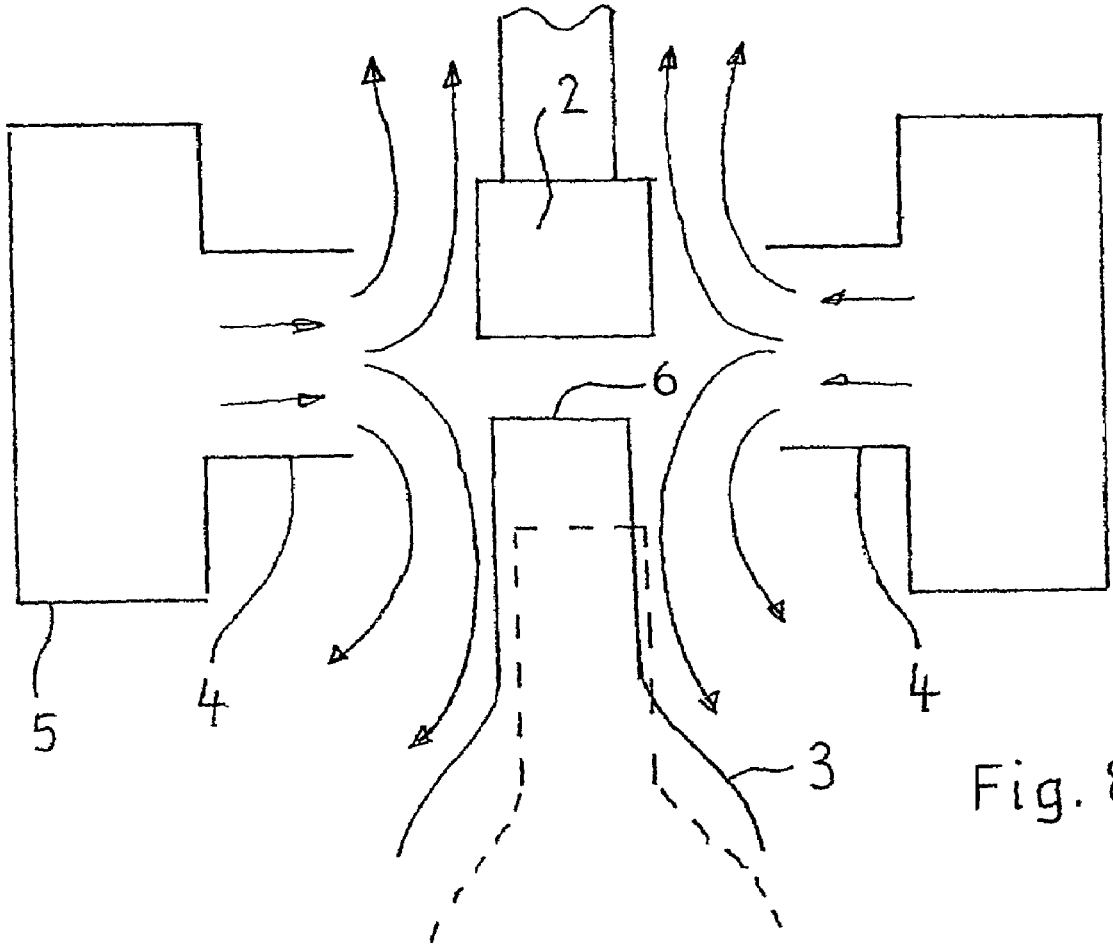

FIG. 8 shows the design of FIG. 1 again, but in a different configuration. The reference numerals are the same in both Figures.

FIG. 8 shows that the nozzle slots of the nozzle 4 may be comparatively wide. It also shows that the mouth 6 of the container 3 is lower than in FIG. 1, namely, where shown in solid lines in FIG. 8, the mouth is situated approximately at the rammed flow's crossing point or also, where shown in dashed lines, underneath the lower edge of the slot nozzles 4, namely inside the downward flow component.

If however the mouth 6 of the container 3 is higher than the plane of symmetry S, as shown in FIG. 1, then the advantage is attained that the mouth 6 is situated in the zone of the upward flow component of the slot nozzles 4 in order that thereby contaminated air issuing from the container 3 may be better entrained upward.

Figure 9:
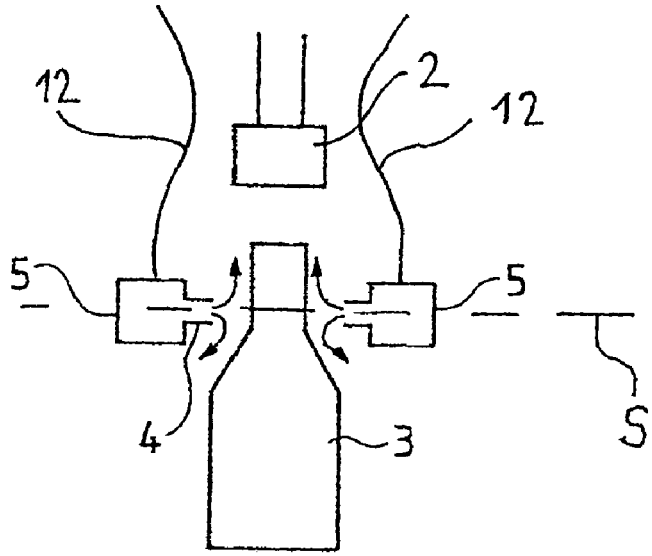
FIG. 9 is a view according to FIG. 1 but comprising screening walls.

FIG. 9 shows the equipment of FIG. 1, however fitted with screening walls 12 similar to those of FIG. 6, though being more aerodynamic, in order to deflect more aerodynamically the upward flow component from the slot nozzles 4 around the treatment implement 2.

The equipment of claim 9 may advantageously correspond to the design of FIG. 3 and be used for instance in a bottling machine as shown in FIG. 7 but without a housing 7, as already mentioned above.

Figure 10:
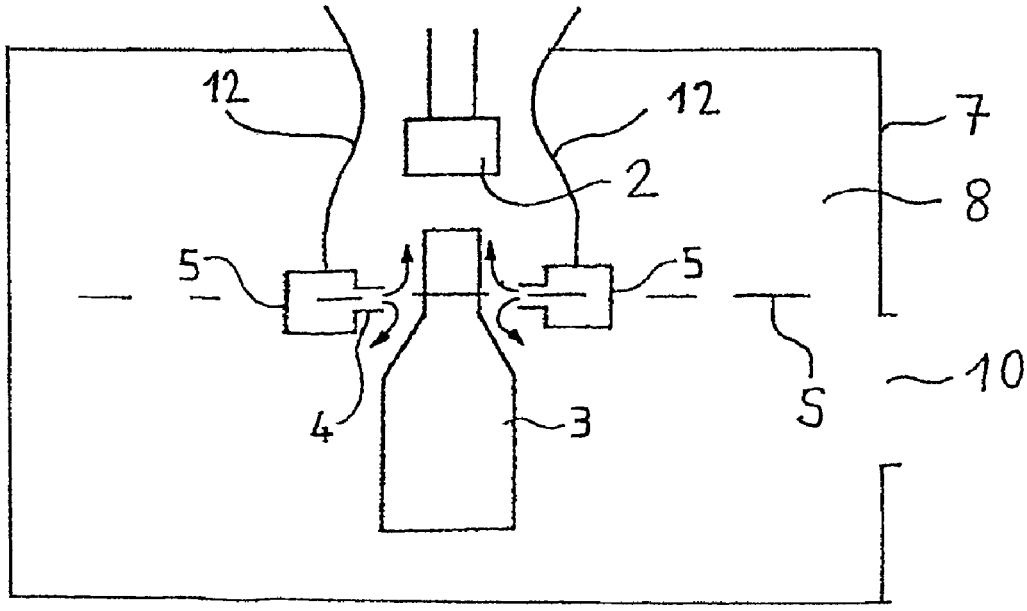
FIG. 10 is a view similar to FIG. 9 but comprising a lower clean gas room.

FIG. 10 shows the equipment of FIG. 9, however being similarly integrated in the housing 7 of a clean gas room 8 as in FIG. 6, the screening walls 12 being configured in the aperture of the housing 7 to improve the design configuration.

The invention claimed is:

1. Equipment for treating open beverage containers (3), for instance filling or sealing them, comprising a treatment site (1) being fed a container (3) for purposes of treatment and being fitted with a treatment implement (2) acting from above on the mouth (6) of the container (3), further comprising slot nozzles (4) which are configured laterally of the treatment site (2) and which blow off a clean gas and are arrayed in a manner to generate a gas curtain protecting the mouth (6) of the container (3), wherein the slot nozzles (4) are configured in substantially mutually opposite air jet directions in such manner that a rammed gas flow is generated between the slot nozzles (4) comprising, relative to the plane of symmetry (S), upward and downward flow components that issue from the region of the slot nozzles (4), the mouths (6) of the containers (3) in the treatment position being configured in one of the flow components, the slot nozzles (4) being configured to communicate at least upward or downward with the free atmosphere.

2. Equipment as claimed in claim 1, wherein the plane of symmetry (S) running through the center of the nozzles is configured below the mouth (6) of the container (3) situated in the treatment position.

3. Equipment as claimed in claim 1, wherein the slot nozzles (4) are configured omnidirectionally in the free atmosphere.

4. Equipment as claimed in claim 1, wherein the equipment comprises several treatment sites (1) configured in a row and two slot nozzles (4) running parallel to said row.

5. Equipment as claimed in claim 4, wherein the slot nozzles (4) are configured in mutually displaceable manner in the direction of said row.

6. Equipment as claimed in claim 1, wherein the equipment comprises a clean gas room (8) wherein the containers (3) may be fed to and evacuated from one or more treatment sites, these treatment sites (1) being configured together with the treatment implements (2) outside the clean gas room (8) in front of at least one aperture (9) which comprises the slot nozzle (4) at its edge and which is part of the clean gas room (8).

7. Equipment as claimed in claim 1, wherein the slot nozzles (4) point obliquely upward or downward.

8. Equipment as claimed in claim 1, wherein the equipment comprises screening walls (12) laterally enclosing the treatment site at each slot nozzle (4).

* * * * *